United States Patent [19]

Asakura et al.

[11] Patent Number: 4,736,720

[45] Date of Patent: Apr. 12, 1988

[54] IDLING SPEED CONTROL SYSTEM FOR INTERNAL COMBUSTION ENGINES

[75] Inventors: Masahiko Asakura, Tokorozawa; Hiroshi Hasebe, Hatogaya; Haruo Shimamura, Saitama; Michio Sakaino, Fujimi, all of Japan

[73] Assignee: Honda Giken Kogyo K.K., Tokyo, Japan

[21] Appl. No.: 875,646

[22] Filed: Jun. 18, 1986

[30] Foreign Application Priority Data

Jun. 21, 1985 [JP] Japan ..... 60-134331
Jun. 21, 1985 [JP] Japan ..... 60-134332
Jun. 21, 1985 [JP] Japan ..... 60-134333

[51] Int. Cl.[4] ..... F02M 23/04
[52] U.S. Cl. ..... 123/339; 123/360
[58] Field of Search ..... 123/339, 340, 585, 587, 123/589, 360, 352

[56] References Cited

U.S. PATENT DOCUMENTS 4,474,153 10/1984 Hanamoto ..... 123/339
4,491,109 1/1985 Kishi ..... 123/339
4,522,175 6/1985 Kamifuji ..... 123/339
4,572,141 2/1986 Hasegawa ..... 123/339

*Primary Examiner*—Ronald B. Cox
*Attroney, Agent, or Firm*—Arthur L. Lessler

[57] ABSTRACT

An idling speed control system for controlling idling rotational speed of an internal combustion engine. A vacuum-operated actuator having a diaphragm defining a vacuum chamber controls opening and closing of a throttle valve in response to first and second control pressures supplied from a change-over control valve to the vacuum chamber. An electronic control unit generates, in response to an on-off control pulse signal having a period corresponding to rotational speed of the engine, one of on-period and off-period of the on-off control pulse signal having a predetermined constant value, and supplies the change-over control valve with the control pulse signal. Preferably, a detector is connected to the electronic control unit for detecting a change in the magnitude of a load on the engine and supplying the electronic control unit with an output signal indicative of the detected change in the load magnitude. The electronic control unit is responsive to the output signal for setting the pulse duration of the on-off control pulse signal to a value different from the above predetermined constant pulse duration. A delay valve provided across a passage connecting between the vacuum chamber and the change-over control valve sets the feeding speed of the first control pressure and that of the second control pressure fed through the passage to different values from each other.

8 Claims, 2 Drawing Sheets

IDLING SPEED CONTROL SYSTEM FOR INTERNAL COMBUSTION ENGINES

BACKGROUND OF THE INVENTION

This invention relates to an idling speed control system for internal combustion engines, and more particularly to a system of this kind which is capable of stabilizing the rotational speed of the engine at idle by controlling the quantity of intake air supplied to the engine.

An internal combustion engine for automotive vehicles is so constructed that the output power and rotational speed thereof are controlled by controlling the quantity of intake air by the use of a throttle valve. In an engine having a carburetor, a throttle valve is generally mounted in the carburetor and so arranged that the opening thereof can be adjusted by of the carburetor. The idling opening of the throttle valve is adjusted, by the use of the idling opening adjusting bolt, to a suitable value at the time of manufacture or maintenance operation of the engine, and therefore the idling opening thus set by the bolt cannot be arbitrarily further adjusted by a driver during operation of the engine.

Since the idling opening of the throttle valve thus has an adjusted fixed value, the rotational speed of the engine is kept constant, if the load on the engine does not vary during idling operation of the engine. However, if the load on the engine varies due to variations in the load on the generator for charging the battery or in the load on the automatic transmission, or due to switching-on and -off of the compressor in the air-conditioner, the rotational speed of the engine correspondingly varies, which makes it difficult to obtain stable idling speed and sometimes results in engine stalling. It is therefore necessary to set a desired idling speed at such a high value as to keep the engine always operating in a stable idling condition, without being influenced by the variations in the engine load. However, if the desired idling speed is set at such a high value, there can occur problems such as occurrence of large noise during idling operation of the engine, and increase of the fuel consumption.

To solve such problems, it has conventionally been proposed e.g. by Japanese Provisional patent publication No. 58-155255 to control the throttle valve opening during idling operation of the engine by the use of a pulse motor. Another method of controlling the idling speed of the engine has been proposed by Japanese Provisional patent publication No. 9-155547, which comprises detecting the rotational speed of the engine by the use of a predetermined crank angle signal, calculating the difference between the detected engine rotational speed and a desired idling speed, and controlling the quantity of intake air bypassing the throttle valve by controlling the duty ratio of a control valve with a control signal corresponding to the difference thus calculated, so as to attain the desired idling speed.

The above proposed methods, however, require complicated control systems as well as expensive control devices and control valves, and thereby are not practical.

SUMMARY OF THE INVENTION

It is the object of the invention to provide an idling speed control system which is simple in construction and can be manufactured at a low cost.

According to the invention, the foregoing object is attained by providing an idling speed control system for controlling idling rotational speed of an internal combustion engine having an intake passage and a throttle valve arranged therein, comprising: vacuum-operated actuator means having a vacuum chamber, and a diaphragm defining the vacuum chamber and operatively connected to the throttle valve for controlling opening and closing thereof in response to pressure in the vacuum chamber; change-over control valve means operatively connected to the vacuum-operated actuator means for supplying the vacuum chamber, selectively, with a first control pressure for opening the throttle valve and a second control pressure for closing the throttle valve; and electronic control means operatively connected to the engine and the change-over control valve means, the electronic control means being adapted to generate an on-off control pulse signal having a pulse repetition period corresponding to rotational speed of the engine, one of on-period and off-period of the control pulse signal having a predetermined constant value, and to supply the change-over control valve means with the on-off control pulse signal.

Preferably, the idling speed control system comprises detecting means connected to the electronic control means for detecting a change in the magnitude of a load on the engine and supplying the electronic control means with an output signal indicative of the detected change in the magnitude of the load on the engine, and means provided in the electronic control means responsive to the output signal from the detecting means for setting the pulse duration of the control pulse signal to a value different from the predetermined constant pulse duration.

Further preferably, the idling speed control system comprises passage means connecting between the vacuum chamber of the vacuum-operated actuator means and the change-over control valve means for feeding the first control pressure and the second control pressure to the vacuum chamber, and delay means provided across the passage means for setting the feeding speed of the first control pressure and that of the second control pressure to different values from each other.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
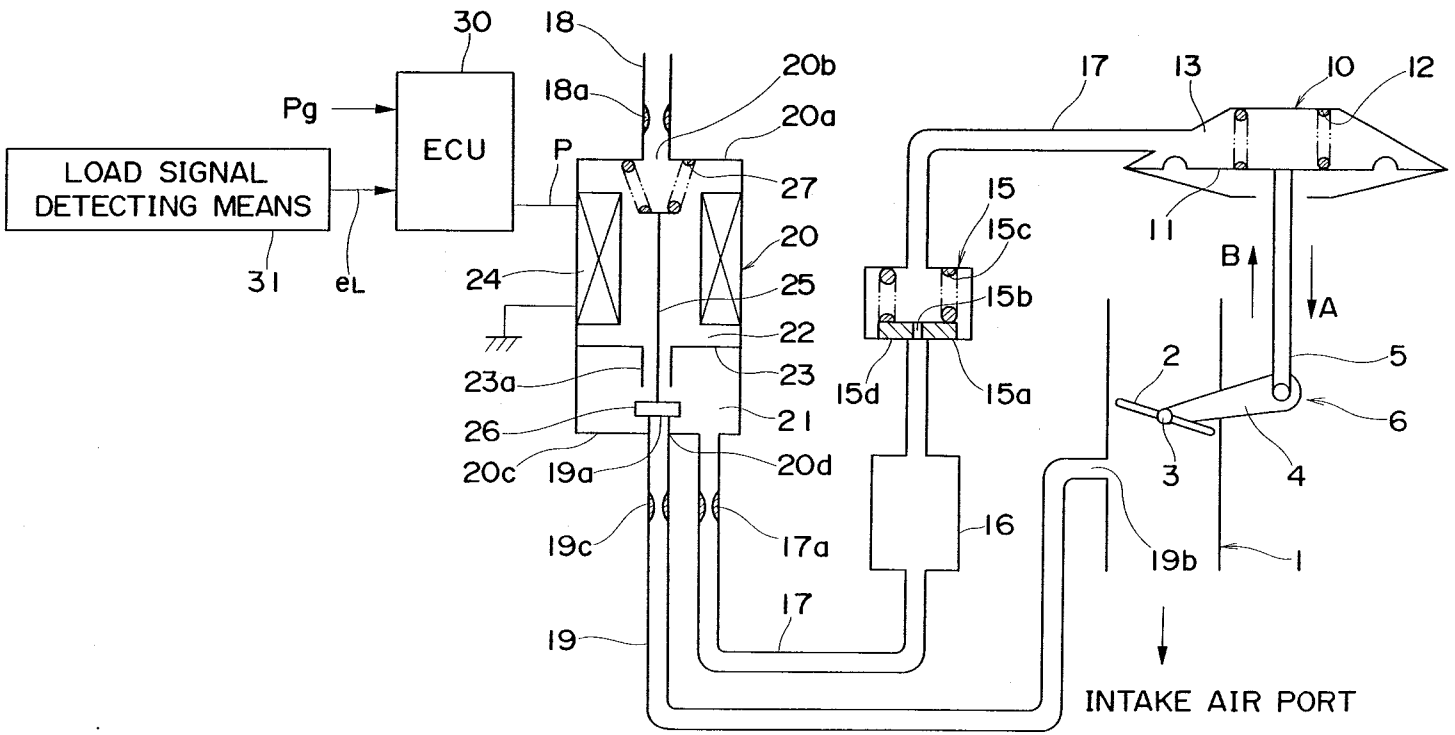
FIG. 1 is a schematic view illustrating the whole arrangement of an idling speed control system for internal combustion engines according to an embodiment of the invention.

Referring now to FIG. 1, there is illustrated the whole arrangement of an idling speed control system according to the invention. Reference numeral 1 designates an intake pipe, one end of which is connected to intake ports, not shown, of the engine, and the other end of which is connected to the atmosphere via an air cleaner, not shown. Arranged in the intake pipe 1 is a throttle valve 2 which is connected to a pneumatic actuator 10 by way of a link mechanism 6 comprising a lever 4 and a rod 5, and the opening of the throttle valve 2 is adjusted by the actuator 10 so that the engine rotational speed approaches a desired idling speed when the engine is operating in an idling condition.

The vacuum-operated actuator 10 is a push type which comprises a diaphragm 11, a vacuum chamber 13, and a coil spring 12. The vacuum chamber 13 communicates with a change-over control valve (hereinafter simply called "the solenoid valve") 20 comprising e.g. a frequency solenoid valve, through a passage 17. On the other hand, the diaphragm 11 is connected to the rod 5.

The solenoid valve 20 is an on-off type, of which a solenoid 24 is energized or deenergized in response to a driving signal from an electronic control unit (hereinafter simply called "the ECU") 30. When the solenoid 24 is energized, a vacuum or negative pressure produced in the intake pipe 1 is introduced into the vacuum chamber 13 in the actuator 10, and when the solenoid 24 is deenergized, the atmospheric pressure is introduced into the vacuum chamber 13.

To be specific, the solenoid valve 20 has two chambers 21 and 22 separated by a partition wall 23 and communicating with each other through a communication port **23*a* provided centrarlly of the partition wall 23. The chamber 22 also communicates with the atmosphere by way of a passage 18 connected to a hole 20*d* formed in an end wall 20*a* of the chamber 22. One end 19*a* of a passage 19 is hermetically inserted into a hole 20*d* formed in an end wall 20*c* of the chamber 21 centrally thereof. The open end 19*a* of the passage 19 projects into the chamber 21 and is opposed to the communication port 23*a* in the partition wall 23 with a predetermined gap, and the other open end 19*b* communicates with the intake pipe 1 at a predetermined location downstream of the throttle valve 2**.

A plunger 25 is axially movably arranged in the solenoid 24 which is accommodated within the chamber 22 in the solenoid valve 20, with one end thereof slidably projected into the chamber 21 through the communication port **23*a*. A valve body 26 is secured to a face of the projected end of the plunger 25, and arranged between the communication port 23*a* and the open end 19*a* of the passage 19 such that it selectively closes the opposed open end of the communication port 23*a* or the open end 19*a* of the passage 19 in response to movement of the plunger 25. A return spring 27 is interposed in a contracted state between the other end of the plunger 25 and the opposed end wall 20*a* of the solenoid 20 so that it urges the plunger 25 in the direction in which the plunger projects into the chamber 21. The valve body 26 is urged against the open end 19*a* of the passage 19 by the return spring 27 when the solenoid 24 is deenergized, thereby closing the passage 19. The solenoid valve 24 has one connection terminal electrically connected to the ECU 30**, and the other connection terminal grounded.

Incidentally, the passages 17, 18, and 19 communicating with the solenoid valve 20 are provided therein respectively with restrictions **17*a*, 18*a*, and 19*c* at predetermined locations thereof for restricting fluctuations in pressure within respective passages which are to be introduced into the chambers 21, 22 of the solenoid 20**.

Further, a surging tank 16 for suppressing fluctuations in pressure within the passage 17 and a delay device 15 are arranged across the passage 17 between the vacuum-operated actuator 10 and the solenoid 20.

The delay device 15 is composed e.g. of a check valve having a valve body **15*a* formed with a restriction hole 15*b* and a spring 15*c* urging the valve body in the closing direction, and so arranged that when the negative pressure introduced into the vacuum chamber 13 is small relative to negative pressure within the chamber 21 of the solenoid valve 20, the valve body 15*a* is in contact with an end wall 15*d*, and when the former is large relative to the latter, the valve body 15*a* is detached from the end wall 15*d*, thereby changing the flow rate through the passage 17 between the valve opening speed and valve closing speed of the throttle valve 2**.

A load signal detecting means 31 detects e.g. an on-off signal indicative of on-off states of an electro-magnetic clutch, not shown, which connects or disconnects a compressor of an air-conditioner, not shown, with or from the engine, or a signal indicative of engagement or disengagement of the transmission gear, and supplies the ECU 30 with a load detection signal $e_L$ indicative of the load on the engine. The signal indicative of engagement or disengagement of the transmission gear is generated e.g. from a sensor which detects a shift lever position in the case where the engine is mounted on a vehicle equipped with an automatic transmission, or from a sensor which detects state of engagement of the clutch disks in the case where the engine is mounted on a vehicle equipped with a manual transmission.

Figure 2:
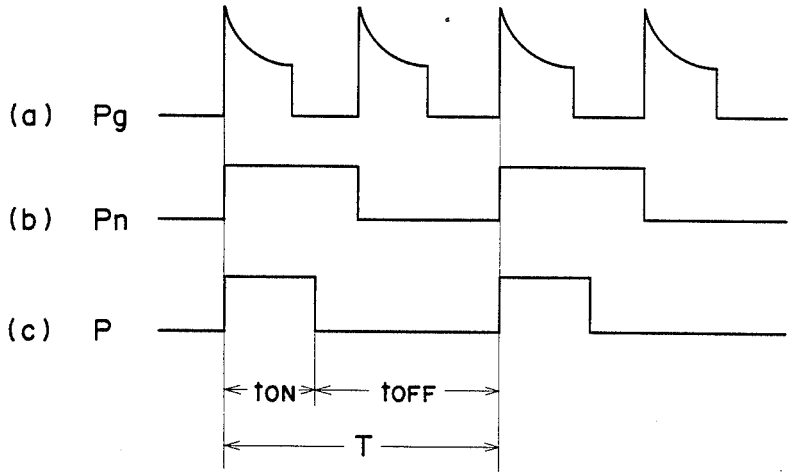
FIG. 2 is a graph showing waveforms of a pulse signal P generated from an electronic control unit appearing in FIG. 1 on the basis of the period of an ignition pulse signal Pg for on-off control of a solenoid valve of the idling speed control system, as well as corresponding processed pulses.

Further supplied to the ECU 30 is a signal generated in synchronism with the engine rotation, e.g. an ignition pulse signal Pg [(a) of FIG. 2] from the primary winding in the ignition coil.

The ECU 30 produces a driving pulse signal P for on-off controlling the solenoid valve 20 on the basis of the ignition pulse signal Pg and the load detection signal $e_L$ inputted thereto and supplies same to the solenoid valve 24.

Reference is now made to the operation of the idling speed control system constructed as above.

When the solenoid 24 is deenergized by the driving signal P supplied from the ECU 30, the plunger 25 is biases toward the open end **19*a* by the urging force of the spring 27 so that the valve body 26 closes the open end 19*a* and opens the communication port 23*a*, whereby the atmosphere is introduced into the vacuum chamber 13 in the vacuum-operated actuator 10. Consequently, the diaphragm 11 of the actuator 10 is displaced in the direction of the arrow A in FIG. 1, by the urging force of the coil spring 12. On the other hand, when the solenoid 24 is energized by the driving signal P, the plunger 25 is attracted by a magnetic force produced by the solenoid 24, overcoming the urging force of the spring 27, to close the communication port 23*a* and open the open end 19*a* of the passage 19, whereby negative pressure developed in the intake pipe 1 is introduced into the vacuum chamber 13. As a result, the diaphragm 11 arranged in the vacuum-operated actuator 10 is displaced in the direction of the arrow B, that is, in the opposite direction to that in which the diaphragm 11 is displaced when the solenoid 24** is deenergized.

In this way, the opening of the throttle valve 2 is selectively controlled to a larger degree or to a smaller degree by controlling the duty ratio of the solenoid 24 of the solenoid valve 20 by the use of the driving signal P supplied from the ECU 30.

Reference is now made to how the driving signal P is generated from the ECU 30.

When the engine is not loaded, the ECU 30 is supplied with a signal generated in synchronism with the engine rotation, e.g. the ignition pulse signal Pg from the primary winding of the ignition coil [(a) of FIG. 2]. The ignition pulse signal Pg has its frequency divided by a predetermined number N, e.g. two, to obtain a pulse signal Pn [(b) of FIG. 2]. Then, the ECU 30 generates a control pulse signal P [(c) of FIG. 2] which is at a high level for a predetermined fixed time period tON from the leading edge of each pulse of the pulse signal Pn.

The pulse repetition period T of the control pulse signal P is the same as that of the pulse signal Pn, wherein the solenoid 24 is energized for the predetermined time period tON and then deenergized for a time period tOFF (=T−tON). Therefore, the duty ratio of the solenoid valve 20 varies in response to the engine rotational speed Ne. To be specific, as described above, the on-period or pulse duration tON of the pulse signal P [(c) of FIG. 2] is set at a predetermined constant value, and the off-period tOFF becomes longer as the engine rotational speed Ne decreases, and vice versa.

Consequently, as the engine rotational speed Ne decreases, the opening period of the communication port 23*a* in the solenoid 20 which communicates with the atmosphere becomes longer, in response to which the negative pressure in the vacuum chamber 13 becomes smaller, so that the diaphragm 11 is displaced by the urging force of the spring 12 to move the rod 5 along the arrow A and thereby open the throttle valve 2. Then, the engine rotational speed Ne increases according to the longer opening action of the throttle valve 2. On the other hand, as the engine rotational speed Ne increases, the opening period of the communication port 23*a* in the solenoid valve 20 becomes shorter, and then the negative pressure PB in the intake pipe becomes higher. As a result, a high negative pressure is introduced into the vacuum chamber 13 of the vacuum-operated actuator 10 and accordingly the negative pressure therein becomes larger, so that the diaphragm 11 is attracted by the higher negative pressure in the vacuum chamber 13 against the urging force in the spring 12 to pull the rod 5 back along the arrow B and thereby close the throttle valve 2. Then, the engine rotational speed decreases according to the closing action of the throttle valve 2.

As described above, when the engine rotational speed Ne at engine idle is high, the ratio of the on-period (constant value) tON of the pulse signal P to the period thereof becomes larger, the negative pressure for operating the diaphragm 11 becomes larger, and accordingly the opening of the throttle valve 2 is decreased. On the contrary, when the engine rotational speed Ne at engine idle is low, the ratio of the on-period tON of the pulse signal P becomes smaller, the operating negative pressure becomes smaller, and accordingly the opening of the throttle valve 2 is increased.

Thus, according to the invention it is not necessary to calculate the duty ratio of the control signal for on-off controlling the solenoid valve 20 and nor necessary to provide expensive control devices such as a pulse motor. The control system according to the invention has a simple structure but is capable of achieving proportional feedback control of the idling speed Ne in response to the engine rotational speed.

Further, according to the invention by virtue of the use of the vacuum-operated actuator using a diaphragm and constructed to open the throttle valve by the atmospheric pressure (a first control pressure), the throttle valve can be opened to a larger degree when the engine is operating at a high altitude than when the engine is operating at a low altitude, since the operating negative pressure becomes smaller with a decrease in the intake pipe vacuum at such high altitude. Accordingly, it is possible to increase the idling speed at the high altitude higher than that at the low altitude and thereby stabilize the idling operation of the engine.

Another function of the control system according to the invention will be described below:

When the engine is loaded due to engagement of the transmission gear and accordingly the load detecting signal $e_L$ indicative of the load applied by the transmission gear is supplied from the load signal detecting means 31 to the ECU 30, the ECU 30 inhibits the pulse signal P from being generated for a predetermined period of time ta from the time the load detecting signal $e_L$ starts to be supplied to the ECU 30. And from the time the signal $e_L$ ceases to be supplied to the ECU 30, the ECU 30 generates a high level signal, i.e. 100% duty ratio signal in place of the pulse signal P for a predetermined period of time tb from the time the signal $e_L$ ceases to be supplied to the ECU 30. The value of the predetermined periods ta and tb depend on the load on the engine.

The inhibition of generation of the pulse signal P for the predetermined period of time ta causes deenergization of the solenoid 24, which lowers the negative pressure in the vacuum chamber 13, and thereby increases the opening of the throttle valve 2. On the contrary, the generation of the high level or 100% duty ratio signal in place of the pulse signal P causes full energization of the solenoid 24, which increases the negative pressure in the vacuum chamber 13 of the pneumatic actuator 10, and thereby decreases the opening of the throttle valve 2. In this way, it is possible to minimize sudden decrease or sudden increase in the engine rotational speed due to a change in the load on the engine.

Figure 3:
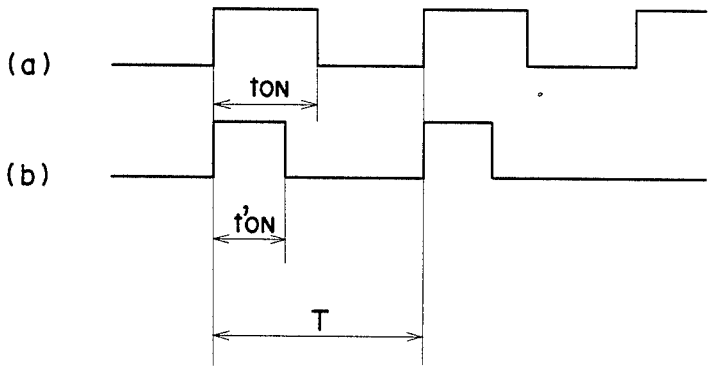
FIG. 3 is a graph showing waveforms of the signal P assumed when the air-conditioner is operating.

A still further function of the control system according to the invention is as follows:

When the engine is loaded by a large load due to actuation of the air-conditioner and the load detecting signal $e_L$ indicative of the load applied by is supplied from the load detecting means 31 to the ECU 30, the ECU 30 generates the pulse signal P having an predetermined on-period t'ON [(b) of FIG. 3] shorter than tON [(a) of FIG. 3], during the time the load detecting signal $e_L$ is supplied to the ECU 30. As a result, the duty ratio of the pulse signal P is smaller to shorten the energizing period of the solenoid 24 and accordingly reduce the negative pressure in the vacuum chamber 13 in the diaphragm 10 so that the opening of the throttle valve 2 becomes longer and then the engine rotational speed is increased.

By virtue of the correction of the on-period tON of the driving signal P to the shorter on-period t'ON during operation of the air-conditioner, it is possible to comply with a requirement that the engine rotational speed should be set at a higher value so as to maintain balance between charging and discharging of the battery during idling operation of the engine with the air-conditioner operating.

The delay device 15 functions as follows:

When the negative pressure within the chamber 21 is smaller than that within the vacuum chamber 13 of the vacuum-operated actuator 10 due to an increase in the quantity of atmospheric air flowing into the chamber 21 of the solenoid valve 20, the valve body 15*a* of the delay valve 15 is acted upon by the differencial force between the negative pressure within the vacuum chamber 13 and that within the chamber 21 against the urging force of the spring 15*c*. Accordingly, atmospheric air is rapidly introduced into the vacuum chamber 13 so that the throttle valve 2 rapidly opens. On the contrary, when the intake pipe negative pressure PB becomes higher so that the negative pressure within the chamber 21 exceeds that within the vacuum chamber 13, the valve body 15*a* is acted upon by the negative pressure within the chamber 21 in the direction of closing the valve body 15*a*. Accordingly, the atmospheric air is slowly introduced into the vacuum chamber 13 so that the throttle valve 2 slowly closes. In this way, the opening speed of the throttle valve 2 is higher than the closing speed of same, and accordingly the increasing speed of the engine rotational speed Ne is higher than the decreasing speed of same, whereby the idling speed can be controlled in a stable manner.

What is claimed is:

1. An idling speed control system for controlling idling rotational speed of an internal combustion engine having an intake passage and a throttle valve arranged therein, comprising:

vacuum-actuated actuator means having a vacuum chamber, and a diaphragm defining said vacuum chamber and operatively connected to said throttle valve for controlling opening and closing thereof in response to pressure in said vacuum chamber;

single change-over control valve means operatively connected to said vacuum-operated actuator means for supplying said vacuum chamber, selectively, with a first control pressure for opening said throttle valve and a second control pressure for closing said throttle valve; and electronic control means operatively connected to said engine and said change-over control valve means, said electronic control means being adapted to generate an on-off control pulse signal having a pulse repetition period inversely proportional to rotational speed of said engine, one of on-period and off-period of said on-off control pulse signal having a predetermined constant value, and to supply said change-over control valve means with said on-off control pulse signal.

2. An idling speed control system for controlling idling rotational speed of an internal combustion engine having an intake passage and a throttle valve arranged therein, comprising:

vacuum-actuated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve;

electronic control means operatively connected to said engine and said change-over control valve means, said electronic control means being adapted to generate an on-off control pulse signal having a pulse repetition period corresponding to rotational speed of said engine, one of on-period and off-period of said on-off control pulse signal having a predetermined constant value, and to supply said change-over control valve means with said on-off control pulse signal;

detecting means connected to said electronic control means for detecting a change in the magnitude of a load on said engine and supplying said electronic control means with an output signal indicative of the detected change in the magnitude of the load on said engine; and means provided in said electronic control means responsive to said output signal from said detecting means for setting the pulse duration of said on-off control pulse signal to a value different from said predetermined constant pulse duration.

3. An idling speed control system for controlling idling rotational speed of an internal combustion engine having an intake passage and a throttle valve arranged therein, comprising:

vacuum-actuated actuator means having a vacuum chamber, and a diaphragm defining said vacuum chamber and operatively connected to said throttle valve for controlling opening and closing thereof in response to pressure in said vacuum chamber;

change-over control valve means operatively connected to said vacuum-operated actuator means for supplying said vacuum chamber, selectively, with a first control pressure for opening said throttle valve and a second control pressure for closing said throttle valve;

passage means connecting between said vacuum chamber of said vacuum-operated actuator means and said change-over control valve means for feeding said first control pressure and said second control pressure to said vacuum chamber;

delay means provided across said passage means for setting the feeding speed of said first control pressure and that of said second control pressure to different values from each other; and electronic control means operatively connected to said engine and said change-over control valve means, said electronic control means being adapted to generate an on-off control pulse signal having a pulse repetition period corresponding to rotational speed of said engine, one of on-period and off-period of said on-off control pulse signal having a predetermined constant value, and to supply said change-over control valve means with said on-off control pulse signal.

4. An idling speed control system as claimed in claim 1, wherein said electronic control means is responsive to a pulse signal indicative of rotational speed of said engine for generating said on-off control pulse signal, said pulse signal indicative of rotational speed of said engine being an ignition pulse signal from said engine.

5. An idling speed control system as claimed in claim 1, 2, 3 or 4, wherein said first control pressure is atmospheric pressure, and said second control pressure is negative pressure in said intake passage.

6. An idling speed control system as claimed in claim 1, 2, 3 or 4, wherein said change-over control valve means comprises a frequency solenoid valve adapted to supply said first control pressure to said vacuum chamber of said vacuum-operated actuator means when deenergized by said on-off control pulse signal, and to supply said second control pressure when energized by said on-off control pulse signal.

7. An idling speed control system as claimed in claim 2, wherein said output signal from said detecting means is indicative of on-off state of a compressor of an air-conditioner which is driven by said engine.

8. An idling speed control system as claimed in claim 3, wherein said delay means comprises a check valve with a restriction and adapted to cause said first control pressure to be supplied at a speed higher than the speed of supplying said second control pressure.

* * * * *